US010573442B2

(12) United States Patent
Shinkai et al.

(10) Patent No.: US 10,573,442 B2
(45) Date of Patent: Feb. 25, 2020

(54) SOFT MAGNETIC MATERIAL, CORE, AND INDUCTOR

(71) Applicant: TDK CORPORATION, Tokyo (JP)

(72) Inventors: Yoshihiro Shinkai, Tokyo (JP); Masahito Koeda, Tokyo (JP); Kyotaro Abe, Tokyo (JP)

(73) Assignee: TDK CORPORATION, Tokyo (JP)

( * ) Notice: Subject to any disclaimer, the term of this patent is extended or adjusted under 35 U.S.C. 154(b) by 80 days.

(21) Appl. No.: 15/868,363

(22) Filed: Jan. 11, 2018

(65) Prior Publication Data

US 2018/0204657 A1 Jul. 19, 2018

(30) Foreign Application Priority Data

Jan. 12, 2017 (JP) ..... 2017-003007
Nov. 29, 2017 (JP) ..... 2017-229182

(51) Int. Cl.

| | |
|---|---|
| ***H01F 1/153*** | (2006.01) |
| ***H01F 27/255*** | (2006.01) |
| ***B22F 1/00*** | (2006.01) |
| ***B22F 1/02*** | (2006.01) |
| ***B22F 3/02*** | (2006.01) |
| ***B22F 3/24*** | (2006.01) |
| ***C22C 45/02*** | (2006.01) |
| ***H01F 17/04*** | (2006.01) |
| ***H01F 1/26*** | (2006.01) |
| ***H01F 17/00*** | (2006.01) |
| ***H01F 3/08*** | (2006.01) |
| *H01F 27/29* | (2006.01) |

(52) U.S. Cl.

CPC ..... *H01F 1/15383* (2013.01); *B22F 1/007* (2013.01); *B22F 1/0074* (2013.01); *B22F 1/02* (2013.01); *B22F 3/02* (2013.01); *B22F 3/24* (2013.01); *C22C 45/02* (2013.01); *H01F 1/15366* (2013.01); *H01F 1/26* (2013.01); *H01F 3/08* (2013.01); *H01F 17/0013* (2013.01); *H01F 17/04* (2013.01); *H01F 27/255* (2013.01); *B22F 2003/248* (2013.01); *B22F 2301/35* (2013.01); *B22F 2998/10* (2013.01); *C22C 2202/02* (2013.01); *H01F 27/292* (2013.01)

(58) Field of Classification Search

None

See application file for complete search history.

(56) References Cited

FOREIGN PATENT DOCUMENTS

JP 2014-204108 A 10/2014
WO WO-2016204008 A1 * 12/2016 ..... C22C 38/00

OTHER PUBLICATIONS

Machine translation JP2014-204108 (Year: 2014).*

* cited by examiner

*Primary Examiner* — Alexandre F Ferre
(74) *Attorney, Agent, or Firm* — Oliff PLC

(57) ABSTRACT

The object of the present invention is to provide the soft magnetic material, the core, and the inductor having high permeability and excellent DC superimposition characteristic.

A soft magnetic material comprising a soft magnetic metal powder and a resin, wherein said soft magnetic metal powder is constituted from a particle group α and a particle group β, when IA is a peak intensity of the particle group α, Vα is the volume of the particle group α, IB is a peak intensity of the particle group β, Vβ is the volume of the particle group β, and IC is a minimum intensity present between the particle group α and the particle group β, then an intensity ratio IC/IA satisfies 0.12 or less, and a volume ratio Vα/Vβ is 2.0 or more and 5.1 or less.

10 Claims, 6 Drawing Sheets

SOFT MAGNETIC MATERIAL, CORE, AND INDUCTOR

BACKGROUND OF THE INVENTION

1. Field of the Invention

The present invention relates to a soft magnetic material, a core, and an inductor.

2. Description of the Related Art

Recently, the electronic devices have attained a high density assembly and also a faster processing, and along with this the inductor is also demanded to have a smaller size while having higher output. However, because of this downsizing, the volume of the core (the core made of a magnetic material) of the inductor decreases which tends to cause a decrease of an inductance and the deterioration of DC superimposition characteristic (the inductance when applying DC current).

Therefore, the core which does not cause the decrease of the inductance and the deterioration of DC superimposition characteristic even in case the inductor is downsized, that is the soft magnetic material having excellent high permeability and DC superimposition characteristic is in demand.

As the invention relating to the conventional soft magnetic material, for example a soft magnetic material, a core, and an inductor disclosed in the patent document 1 are known. Said soft magnetic material includes a resin, a first soft magnetic metal powder having a particle size of 20 μm or more and 50 μm or less, and a second soft magnetic metal powder having a particle size of 1 μm or more and 10 μm or less, wherein said first and second soft magnetic metal powders are insulation coated. Further, when a ratio between a mass % of the first soft magnetic metal powder and a mass % of the second soft magnetic metal powder is A:B, then "A" and "B" satisfies A+B=100, and 15≤A≤35 and 65≤B≤85.

[Patent document 1] JP Patent Application Laid Open No. 2014-204108

SUMMARY

The patent document 1 discloses the constitution wherein the ratio of the second soft magnetic metal powder which is the fine powder having the particle size of 1 μm or more and 10 μm or less is larger than the ratio of the first soft magnetic metal powder which is the coarse powder having the particle size of 20 μm or more and 50 μm or less. Therefore, the filling rate of the soft magnetic material was unable to increase sufficiently. The core having the same constitution as disclosed in the patent document 1 was produced, only to confirm that it was not sufficient enough to attain high permeability and good DC superimposition characteristic which can satisfy the current needs of downsizing.

Thus, the present invention was attained in view of such circumstances, and the object is to provide the soft magnetic material, the core, and the inductor having high permeability and excellent DC superimposition characteristic.

The soft magnetic material of the present invention has a soft magnetic metal powder and a resin, wherein said soft magnetic metal powder is comprised of a particle group α and a particle group β, when IA is a peak intensity of the particle group α, Vα is a volume of the particle group α, IB is a peak intensity of the particle group β, Vβ is a volume of the particle group β, and IC is a minimum intensity present between the particle group α and the particle group β, then an intensity ratio IC/IA satisfies 0.12 or less and a volume ratio Vα/Vβ satisfies 2.0 or more and 5.1 or less. Note that, the particle group α is the particle group having a maximum peak intensity in a size distribution of said soft magnetic metal powder and a peak particle size PA of the particle group α is larger than a peak particle size PB of the particle group β. Also, when the peak intensity of the particle group α is defined as IA1, IA2 . . . IAx (x is 1 or larger) which is the decreasing order of the peak intensity, then the peak intensity IA of the particle group α is the largest peak intensity IA1 and the peak particle size PA of the particle group α is PA1, and when the peak intensity of the particle group β is defined as IB1, IB2 . . . IBy (y is 1 or larger) which is the decreasing order of the peak intensity, then the peak intensity IB of the particle group α is the largest peak intensity IB1 and the peak particle size PB of the particle group β is PB1.

That is, the particles having the intermediate particle size which falls between the particle group α and the particle group β are little. Therefore, the small size particles of the particle group β can be efficiently filled into the space formed between the large size particles of the particle group α. Also, the filling rate of the soft magnetic particles which is the sum of the particle group α and the particle group β can be increased. It is thought that a high permeability and a good DC superimposition characteristic can be attained as a result of this. However, the effect is not limited to this.

Preferably, the peak particle size PA of said particle group α is 60 μm or less. By having the peak particle size PA of said particle group α within the above mentioned range, DC superimposition characteristic improves, and forms the compositional state wherein the resin part and the space part are rarely localized. Thereby, the composition of the sample is speculated to be uniform. Note that, the effect is not limited to this.

Preferably, the soft magnetic metal powder constituting said particle group α is Fe or a metal comprising Fe, and the soft magnetic metal powder is coated with an insulation material. By using Fe or the metal including Fe with high saturation magnetization, high permeability and good DC superimposition characteristic tends to be attained. Also, by coating with the insulation material, good DC superimposition characteristic tends to be attained. Note that, "by coating" means to coat part of or entire particle.

The core according to one embodiment of the present invention is produced by said soft magnetic material.

The inductor according to one embodiment of the present invention includes said core.

According to the present invention, the soft magnetic material, the core, and the inductor having a high permeability and an excellent DC superimposition characteristic can be provided.

DETAILED DESCRIPTION

Hereinafter, the embodiment of the present invention will be described, however the present invention is not to be limited thereto. Also, the constitution of the embodiment described in below includes those which can be easily attained by ordinary skilled in the art, those which is substantially the same, and those which is within the equivalent range.

The soft magnetic material of the present invention has a soft magnetic metal powder and a resin, wherein said soft magnetic metal powder is comprised of a particle group α and a particle group β, when IA is a peak intensity of the particle group α, Vα is a volume of the particle group α, IB is a peak intensity of the particle group β, Vβ is a volume of the particle group β, and IC is a minimum intensity present between the particle group α and the particle group β, then an intensity ratio IC/IA satisfies 0.12 or less and a volume ratio Vα/Vβ satisfies 2.0 or more and 5.1 or less. Note that, the particle group α is the particle group having a maximum peak intensity in a size distribution of said soft magnetic metal powder and a peak particle size PA of the particle group α is larger than a peak particle size PB of the particle group β. Also, when the peak intensities of the particle group α are defined as IA1, IA2 . . . IAx (x is 1 or larger) which is in the decreasing order of the peak intensity, then the peak intensity IA of the particle group α is the largest peak intensity IA1 and the peak particle size PA of the particle group α is PA1. Further, when the peak intensities of the particle group β are defined as IB1, IB2 . . . IBy (y is 1 or larger) which is in the decreasing order of the peak intensity, then the peak intensity IB of the particle group α is the largest peak intensity IB1 and the peak particle size PB of the particle group β is PB1. Further, the point having the minimum intensity IC between the group α and the particle group β is "C", and the particle size of "C" is defined "PC".

The peaks A1, A2 . . . Ax (x is 1 or larger), B1, B2 . . . By (y is 1 or larger), and point C can be determined from the size distribution based on a volume which are calculated using a laser diffraction scattering method; and from the peak and the point thereof, the peak particle sizes PA1, PA2 . . . PAx (x is 1 or larger) and PB1, PB2 . . . PBy (y is 1 or larger); the peak intensities IA1, IA2 . . . IAx (x is 1 or larger) and IB1, IB2 . . . IBy (y is 1 or larger); the particle size PC of the point C; and the intensity IC can be calculated. Also, in the size distribution based on the volume, the particle group having larger particle size than PC is defined as the particle group α and the particle group having smaller particle size than PC is defined as the particle group β, and the volume Vα of the particle group α and the volume Vβ of the particle group β can be calculated.

Figure 1A:
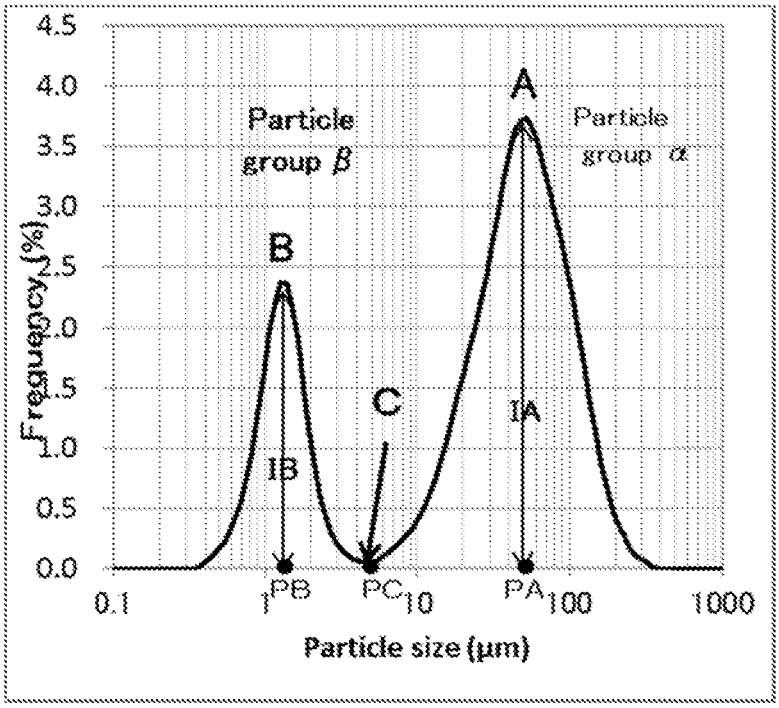
FIG. 1A is a diagram showing the size distribution (frequency distribution) of the soft magnetic material of the example 5.
Figure 1B:
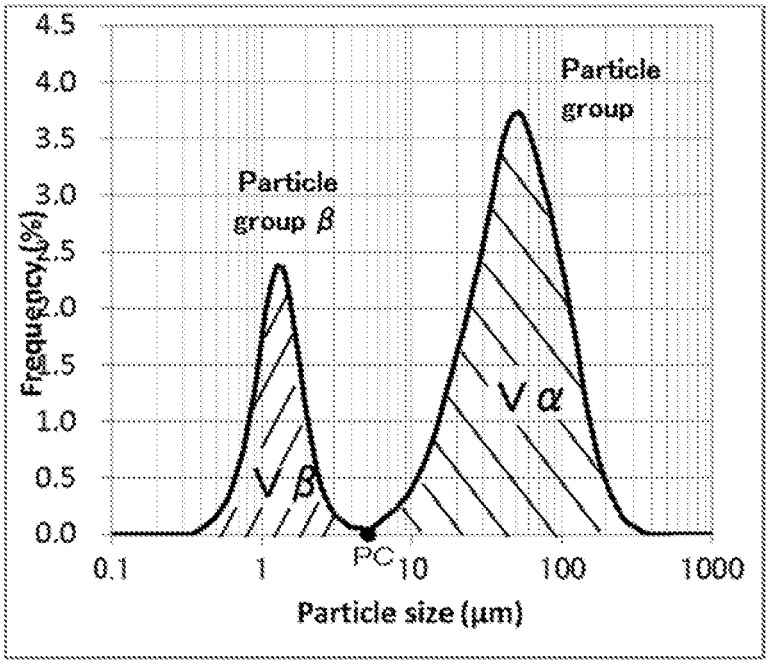
FIG. 1B is a diagram showing the size distribution (frequency distribution) of the soft magnetic material of the example 5.
Figure 2:
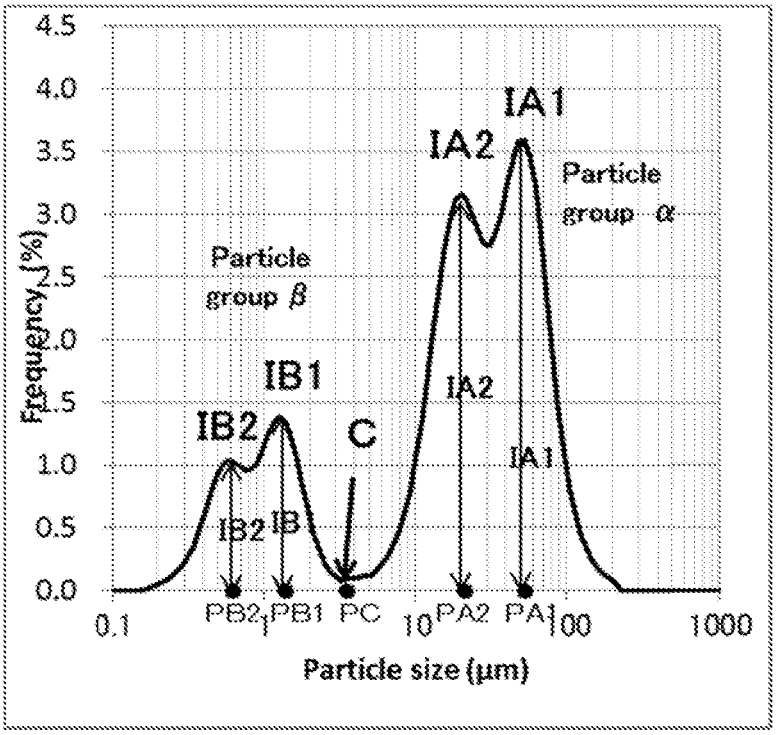
FIG. 2 is a diagram showing the size distribution (frequency distribution) of the soft magnetic material of the example 15.

FIG. 1 is the example of the size distribution showing the embodiment of the present invention. FIG. 1 shows that when the volume ratio Vα/Vβ satisfies 2.0 or more and 5.1 or less and when the small size particles of the particle group β are efficiently filled into the space between the large size particles of the particle group α, then the filling rate of the soft magnetic particles which is the sum of the particle group α and the particle group β can be increased. As shown in FIG. 2, when the intensity ratio IC/IA is larger than 0.12, then the particle having the intermediate size between the particle group α and the particle group β increases, therefore a high filling rate cannot be attained. Also, if the volume ratio Vα/Vβ is larger than 5.1, the small size particle of the particle group β will not be enough and easily form a space. Further, if the volume ratio Vα/Vβ is smaller than 2.0, then the small size particles of the particle group β will be too much, and these particles may cause the decrease in the filling rate.

The intensity ratio IC/IA is preferably 0.008 or more and 0.08 or less, and more preferably 0.01 or more and 0.06 or less. When the intensity ratio IC/IA is small, high filling rate tends to be obtained, but when it is 0.003 or less, the filling rate tends to decrease.

The volume ratio Vα/Vβ is preferably 2.5 or more and 4.4 or less, and more preferably 3.0 or more and 4.0 or less. By having such constitution, the filing rate tends to be high, and the deterioration of DC superimposition characteristic tends to be suppressed from deteriorating.

The peak particle size PA of the particle group α is preferably 60 μm or less. When the peak particle size PA becomes large, DC superimposition characteristic tends to deteriorate; and when the peak particle size PA becomes small, then the permeability tends to decrease. From the point of the permeability and DC superimposition characteristic, the peak particle size PA of the particle group α is preferably 10 to 60 μm, and more preferably 15 to 60 μm. The peak particle size of the powder used for the particle group a can regulate the size distribution by removing the coarse particle and the fine particle using a classifier.

As the particle of the particle group α, the particle produced by an atomization method such as a water atomization method or a gas atomization method can be used. Generally, the particle with higher roundness can be easily obtained using the gas atomization method, however the particle having a high roundness can be obtained by appropriately regulating the spray condition or so even in case of using the water atomization method.

The soft magnetic metal powder constituting the particle group α is preferably Fe or the metal including Fe (including alloy), and the surface is preferably coated with the insulation material. As the metal including Fe, an amorphous alloy of Fe—B—Si—Cr based, Fe—Si—Cr based, Fe—Ni—Si—Co based, and Fe—Si—B—Nb—Cu based may be mentioned. Also, as the insulation material for coating, any coating material may be selected from phosphate glass; a compound including one or more selected from the group consisting of MgO, CaO, and ZnO; a mixed boron compound made from aqueous solution or water dispersion including boron; titanium oxide made from titanium alkoxides; and silicon oxides or so.

Also, as the soft magnetic metal powder constituting the particle group α, plurality of metal particles may be mixed and used. For example, the surface of the particle made of Fe and the surface of the particle made of Fe—B—Si—Cr based amorphous alloy which are insulation coated with boron compound can be mixed and used; and the particle made of Fe—B—Si—Cr based amorphous alloy of which the surface is the insulation coated with boron compound can be mixed with the particle made of Fe and used.

Form the point of improving the filling rate of the soft magnetic metal particle, the peak particle size PB of the particle group β is preferably 0.5 μm to 5 more preferably 0.7 μm to 4 and further preferably 0.7 μm to 2 μm. The peak particle size of the powder used for the particle group β can be set to have a desirable peak particle size by regulating the size distribution by removing the coarse particle and the fine particle using the classifier.

As the particle of the particle group β, the particle produced by the atomization method such as the water atomization method or the gas atomization method similar to the particle group α, also several μm particle produced by a carbonyl method, and submicron particle produced by the spray pyrolysis method or so can be used.

As the soft magnetic metal powder constituting the particle group β, Fe or the metal including Fe (including alloy) can be used, and the composition may differ from the particle group α. As the metal including Fe, for example Fe—Ni based alloy may be mentioned. Regarding the particle group β, the particle of which the surface is coated with the insulation material can be used as similar to the particle group α. As the insulation material, any coating material such as mentioned in the above can be selected.

Also, as the soft magnetic metal powder constituting the particle group β, plurality of metal particles may be mixed and used as similar to the above mentioned particle group α.

For the soft magnetic material of the present embodiment, the insulation between the soft magnetic particles is maintained by the resin. However, by using the powder carried out with the insulation treatment to the surface of the soft magnetic particle, higher insulation property and better DC superimposition characteristic can be attained, and when used as the inductor, further preferable insulation property, the voltage resistance, and DC superimposition characteristic can be attained.

Also, the soft magnetic material of the present embodiment preferably includes 65 to 83 wt % of the particle of the particle group α, 15 to 30 wt % of the particle of particle group β, and 1.5 to 5 wt % of the resin. By constituting as such, the resin can fill between the particle of the particle group α and the particle of particle group β; thereby the space can be decreased.

As the resin, for example various organic polymer resins such as a silicone resin, a phenol resin, an acrylic resin, and an epoxy resin or so may be mentioned, but it is not limited thereto. These can be used alone or by combining two or more. Further, if necessary, known curing agent, crosslinking agent, and lubricant or so may be blended. Also, a liquid form resin, or a resin dissolved in an organic solvent may be used, but the epoxy resin of liquid form is preferable.

On the other hand, the soft magnetic material of the present embodiment is preferably used as the paste capable of print coating or so, and if necessary, the viscosity of the paste may be regulated by a solvent or a dispersant.

The core of the present embodiment can be produced by filling the paste including the above mentioned soft magnetic material to the mold of any shape, and then carrying out the heat curing. If a volatile component such as the solvent or so is included, it can be dried to a semi-cured condition, then the pressure is applied, followed by heat curing thereby the core can be produced. Note that, the particle size of the soft magnetic metal powder during the production of the core does not change, hence when the soft magnetic material is a core, the particle group α and the particle group β maintain the size distribution of the soft magnetic material mentioned in above.

Figure 5:
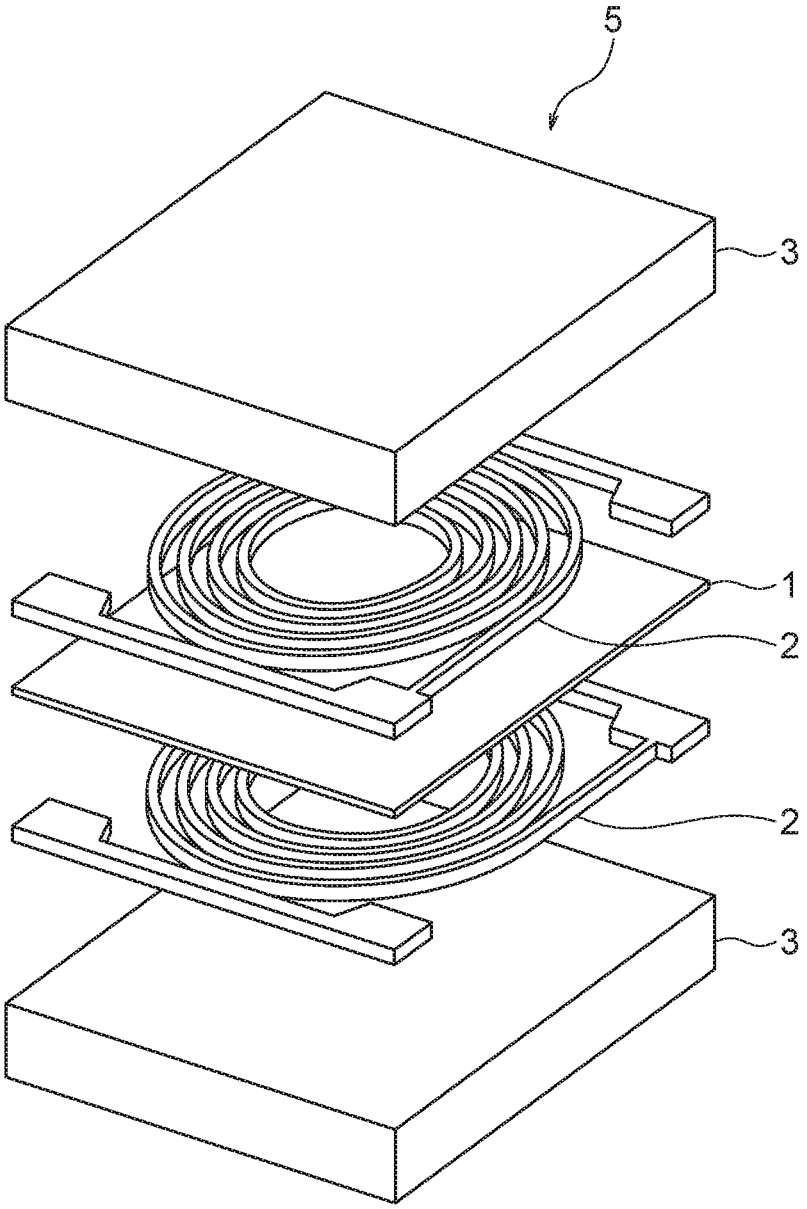
FIG. 5 is a schematic diagram of the internal structure of the thin film inductor.
Figure 6:
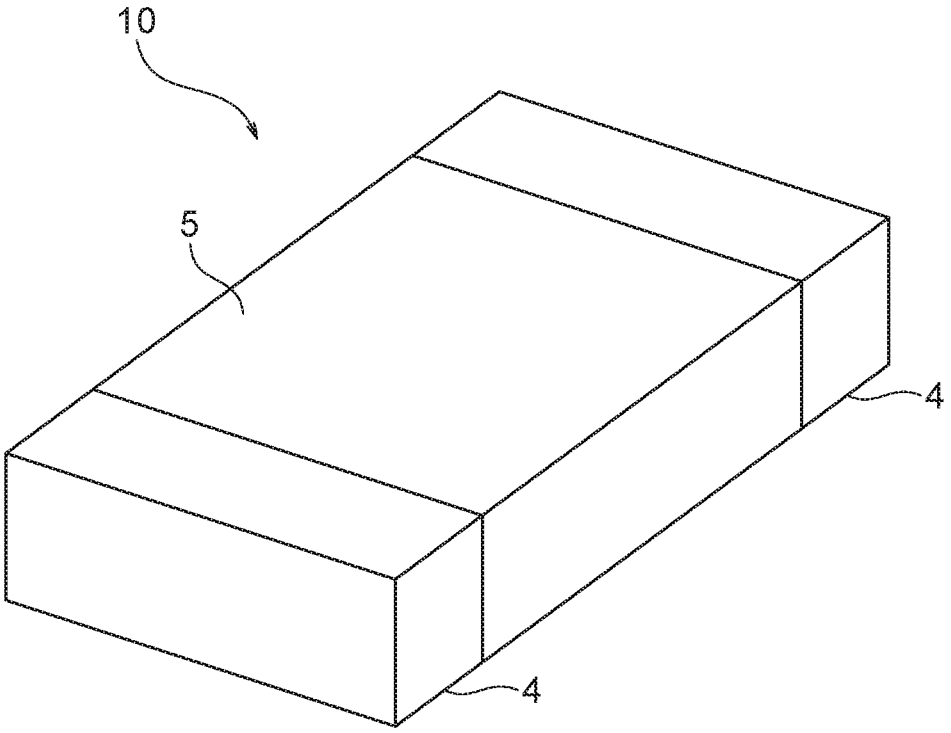
FIG. 6 is a schematic diagram of the appearance of the thin film inductor.

The core of the present embodiment can be used to various types of the inductor such as a thin film inductor, a multilayer inductor, a coil inductor or so. As one example, the constitution of the thin film inductor is shown. FIG. 5 is the schematic diagram of the internal structure of the element body 5 of the thin film inductor 10, and FIG. 6 is the schematic diagram of the appearance of the thin film inductor 10. The reference number "1" of FIG. 5 is the substrate using the material which is chosen from any of resin, ceramic, and ferrite or so, and the internal conductor 2 of a spiral shape formed of silver or copper are formed on the top and bottom faces of the substrate. The conductors on the top and bottom faces are connected via a through hole formed to the substrate 1. Further, the reference number "3" is a magnetic layer, and it is a core of the present embodiment. The reference number "4" of FIG. 6 is an external electrode connected to the internal electrode indicated by the reference number "2", and nickel is further plated to the surface of silver foundation electrode, and tin is plated thereon.

Next, the production method of the thin film inductor as an example of the inductor will be described.

The internal electrode of a spiral shape is formed to the top and bottom faces of the resin substrate by the spattering method or a photolithography method. Further, the soft magnetic material of a paste form of the present embodiment is printed to said substrate face to form the magnetic layer, then heat curing is carried out at the temperature of 150 to 200° C. Thereby, the base substrate formed with plurality of the internal electrodes of the spiral form is obtained. This base substrate is formed with plurality of the internal electrode patterns, and then it is cut into individual chip via a cutting step using a slicer. Then, a barrel polishing or so is carried out so that the internal electrode and the external electrode can be connected easily. The chip obtained as such is fixed such that the face where the internal electrode is exposed is facing up, and then the external electrode is formed via a thinning step such as spattering or so. Further, the thin film inductor can be produced by going through the step of nickel plating and tin plating to the external electrode surface.

EXAMPLE

Hereinafter, the present invention will be described based on the examples and the comparative examples; however the present invention is not to be limited to the examples.

As the soft magnetic metal powder, the powder made of Fe-2.5 mass % of B-6.4 mass % of Si-2.1 mass % of Cr based amorphous alloy produced by the water atomization method and the surface coated by the phosphate glass, wherein the average particle size D50 of 72.9 μm (D10: 27.8 μm, D90: 173 μm), 56.4 μm (D10: 21.3 μm, D90: 134 μm), 51.8 μm (D10: 19.7 μm, D90: 124 μm), 49.0 μm (D10: 26.5 μm, D90: 87.2 μm), 47.5 μm (D10: 17.9 μm, D90: 113 μm), 21.8 μm (D10: 8.2 μm, D90: 52.1 μm), 19.6 μm (D10: 9.4 μm, D90: 30.8 μm), and 9.1 μm (D10: 3.8 μm, D90: 21.6 μm) were respectively prepared. Also, as the soft magnetic metal powder, the carbonyl iron powder produced by the carbonyl method having the average particle size D50 of 3.2 μm (D10: 1.9 μm, D90: 5.1 μm) and 1.3 μm (D10: 0.7 μm, D90: 2.0 μm) were respectively prepared. Further, as the soft magnetic metal powder, the iron powder produced by the spray pyrolysis method having the average particle size D50 of 0.52 μm (D10: 0.30 μm, D90: 0.84 μm) was prepared.

Note that, the above mentioned "Fe-2.5 mass % of B-6.4 mass % of Si-2.1 mass % of Cr" means that when the total was 100 mass %, B was 2.5 mass %, Si was 6.4 mass %, and Cr was 2.1 mass %, and the rest was Fe. For the examples hereinafter, the same applies.

Example 1

As the powders of the particle group α and the particle group β, the powders respectively having the average particle size D50 of 9.1 μm and 0.52 μm were blended in a weight ratio of 35:10, thereby the soft magnetic metal powder of the example 1 having the peak particle size shown in Table 1 was obtained. Next, 2.5 wt % of liquid epoxy resin was added, and thoroughly kneaded while regulating the viscosity by adding the organic solvent, thereby the soft magnetic material of a paste form of the example 1 was obtained. Further, the soft magnetic material of a paste form was filled into the mold having a groove of a toroidal shape, then this was dried to a semi-dried state and the pressure was applied. Then it was taken out of the mold, and the heat curing was carried out in the thermostat chamber, thereby the core of the example 1 of a toroidal shape having the outer diameter of 15 mm, the inner diameter of 9 mm, and the thickness of 0.7 mm was obtained.

Examples 2 to 4

The soft magnetic powder, the soft magnetic material, and the core of the examples 2, 3, and 4 were obtained as same as the example 1 except for using the powders of the of the particle group α and the particle group β respectively having the average particle size D50 of 21.8 μm and 1.3 μm, and blended in a weight ratio of 30:10, 40:10, and 23:10.

Examples 5 to 7 and 9, Comparative Examples 4 and 5

The soft magnetic powder, the soft magnetic material, and the core of the examples 5, 6, 7, and 9, the comparative examples 4 and 5 were obtained as same as the example 1 except for using except for using the powders of the of the particle group α and the particle group β respectively having the average particle size D50 of 47.5 μm and 1.3 μm, and blended in a weight ratio of 27:10, 35:10, 45:10, 20:10, 50:10, and 15:10.

Example 8

The soft magnetic powder, the soft magnetic material, and the core of the example 8 were obtained as same as the example 1 except for using the powders of the of the particle group α and the particle group β respectively having the average particle size D50 of 47.5 μm and 3.2 μm, and blended in a weight ratio of 40:10.

Example 10

The soft magnetic powder, the soft magnetic material, and the core of the example 10 were obtained as same as the example 1 except for using the powders of the of the particle group α and the particle group β respectively having the average particle size D50 of 51.8 μm and 1.3 μm, and blended in a weight ratio of 33:10.

Example 11

The soft magnetic powder, the soft magnetic material, and the core of the example 11 were obtained as same as the example 1 except for using the powders of the of the particle group α and the particle group β respectively having the average particle size D50 of 56.4 μm and 1.3 μm and blended in a weight ratio of 33:10.

Example 12

The soft magnetic powder, the soft magnetic material, and the core of the example 12 were obtained as same as the example 1 except for using the powders of the of the particle group α and the particle group β respectively having the average particle size D50 of 72.9 μm and 1.3 μm and blended in a weight ratio of 40:10.

Examples 13 and 15

The soft magnetic powder, the soft magnetic material, and the core of the examples 13 and 15 were obtained as same as the example 1 except for using the powders of the of the particle group α and the particle group β respectively having the average particle size D50 of 49.0 μm, 19.6 μm, 1.3 μm, and 0.52 μm blended in a weight ratio of 27:33:12:8, and in a weight ratio of 33:327:12:8.

Example 14 and Comparative Example 1

The soft magnetic powder, the soft magnetic material, and the core of the examples 14 and the comparative example 1 were obtained as same as the example 13 except for using the powders of the of the particle group α and the particle group β respectively having the average particle size D50 of 49.0 μm, 19.6 μm, 3.2 μm, and 1.3 μm blended in a weight ratio of 28:30:12:8, and in a weight ratio of 27:33:12:8.

Comparative Example 2

The magnetic material and the core of the comparative example 2 were obtained as same as the example 1 except for only using the powder having the average particle size D50 of 1.3 μm as the soft magnetic metal powder.

Comparative Example 3

The magnetic material and the core of the comparative example 3 were obtained as same as the example 1 except for only using the powder having the average particle size D50 of 47.5 μm as the soft magnetic metal powder.

Example 16

The soft magnetic metal powder, the soft magnetic material, and the core of the example 16 were obtained as same as the example 1 except for the conditions shown in below. That is, in the example 16, as the powder of the particle group α, the powder having the average particle size D50 of 45.2 μm (D10: 16.9 μm, D90: 114.0 μm) and made of Fe-2.5 mass % of B-6.4 mass % of Si-2.1 mass % of Cr based alloy was prepared. Further, as the powder of the particle group β, the powder having the average particle size D50 of 1.3 μm (D10: 0.7 μm, D90: 2.0 μm) and made of carbonyl iron produced by the carbonyl method was prepared. The powder of the particle group α and the powder of the particle group β were blended in the weight ratio of 40:10.

Example 17

The soft magnetic metal powder, the soft magnetic material, and the core of the example 17 were obtained as same as the example 16 except for the powder having the average particle size D50 of 23.6 μm (D10: 8.8 μm, D90: 57.0 μm) wherein the surface is insulation coated with silica, and made of Fe-2.5 mass % of B-6.4 mass % of Si-2.1 mass % of Cr based amorphous alloy of spherical shape produced by the water atomization method was used as the powder of the particle group α.

Example 18

The soft magnetic metal powder, the soft magnetic material, and the core of the example 18 were obtained under the same condition as the example 16 except for the powder having the average particle size D50 of 43.6 μm (D10: 16.2 μm, D90: 79.2 μm) wherein the surface is insulation coated with phosphate glass, and made of Fe-6.5 mass % of Si-2.5 mass % of Cr based amorphous alloy of spherical shape produced by the water atomization method was used as the powder of the particle group α.

Example 19

The soft magnetic metal powder, the soft magnetic material, and the core of the example 19 were obtained as same as the example 16 except that the powder having the average particle size D50 of 23.0 μm (D10: 8.1 μm, D90: 56.7 μm) wherein the surface is insulation coated with phosphate glass, and made of Fe-44 mass % of Ni-2.1 mass % of Si-4.5 mass % of Co based amorphous alloy of spherical shape produced by the water atomization method was used as the powder of the particle group α.

Example 20

The soft magnetic metal powder, the soft magnetic material, and the core of the example 20 were obtained as same as the example 16 except for the conditions shown in below. That is, in the example 20, as the powder of the particle group α, the powder having the average particle size D50 of 21.8 μm (D10: 8.0 μm, D90: 51.9 μm) which the surface is insulation coated by the phosphate glass, and made of Fe-13.0 mass % of Si-9.0 mass % of B-3.0 mass % of Nb-1.0 mass % of Cu based amorphous alloy of spherical shape produced by the water atomization method was prepared. The powder of the particle group α and the powder of the particle group β were blended in the weight ratio of 35:10.

Example 21

The soft magnetic metal powder, the soft magnetic material, and the core of the example 21 were obtained as same as the example 16 except for the conditions shown in below. That is, in the example 21, as the powder of the particle group α, the powder having the average particle size D50 of 47.5 μm (D10: 17.9 μm, D90: 113 μm) wherein the surface is insulation coated with phosphate glass, and made of Fe-2.5 mass % of B-6.4 mass % of Si-2.1 mass % of Cr based amorphous alloy of spherical shape produced by the water atomization method was prepared. Further, as the powder of the particle group β, the powder having the average particle size D50 of 1.3 μm (D10: 0.8 μm, D90: 2.2 μm) made of carbonyl iron powder produced by the carbonyl method and the surface being insulation coated with silica was prepared. The powder of the particle group β and the powder of the particle group α were blended in the weight ratio of 30:10.

Example 22

The soft magnetic metal powder, the soft magnetic material, and the core of the example 22 were obtained as same as the example 21 except that the powder having the average particle size D50 of 0.8 μm (D10: 0.5 μm, D90: 1.3 μm) which the surface is insulation coated with silica, and made of Fe-50 mass % of Ni based alloy produced by the spray pyrolysis method was used as the powder of the particle group β.

Example 23

The soft magnetic metal powder, the soft magnetic material, and the core of the example 23 were obtained as same as the example 16 except for the powder having the average particle size D50 of 38.2 μm (D10: 9.4 μm, D90: 92.5 μm) made of Fe of spherical shape produced the water atomization method was used as the powder of the particle group α.

The size distribution measuring method, the measuring condition of the filling rate of the soft magnetic metal powder, the permeability and DC superimposition characteristic of the core having the toroidal shape were as described in below.

(Size Distribution Measurement)

The powder, water, and the dispersant were introduced in the homogenizer (made by Nippon Seiki Co., Ltd.) and dispersed. Then, the peaks A1, A2 . . . Ax (x is 1 or larger), the peaks B1, B2 . . . By (y is 1 or larger), and the point C were determined by the size distribution based on a volume obtained by a wet laser diffraction particle size distribution analyzer (Microtrac MT3300EXII made by Nikkiso Co., Ltd.). Then, the peak particle size PA1, PA2 . . . PAx (x is 1 or larger), PB1, PB2, PBy (y is 1 or larger), the peak intensity (frequency) IA1, IA2 . . . IAx (x is 1 or larger), IB1, IB2 . . . IBy (y is 1 or lerger), the particle size PC of the point C, and the intensity (frequency) IC were calculated. Also, in the size distribution based on the volume, the particle group having larger particle size than PC was defined as the particle group α and the particle group having smaller particle size than PC was defined as the particle group β; then the volume Vα of the particle group α and the volume Vβ of the particle group β were calculated. Note that, when the same size distribution measurement was carried out to the soft magnetic metal powder of which included in the obtained soft magnetic material and the core, the same size distribution as the soft magnetic metal powder before being used to the soft magnetic material and the core was obtained.

(Filling Rate of the Soft Magnetic Metal Powder)

The density was measured by Archimedes method using the core having the toroidal shape, and then the filling rate was obtained by the specific gravity of various materials.

(Condition of measuring the permeability)

Size of the core having the toroidal shape: outer diameter of 15 mm×inner diameter of 9 mm×thickness of 0.7 mm Measuring device: E4991A (made be Aglient) RF impedance/Material analyzer Measuring frequency: 3 MHz (Condition of Measuring DC Superimposition Characteristic)

Size of the core having the toroidal shape: outer diameter of 15 mm×inner diameter of 9 mm×thickness of 0.7 mm Number of coils: 30

Measuring device: 4284A (made be Aglient) Precision LCR meter

Frequency of high frequency signal: 100 kHz

DC superimposition characteristic was evaluated based on the decreasing rate of the inductance when DC bias current was applied from OA to 10A.

Table 1 shows the peak particle size PA1, PA2, PB1, PB2 of the particle group α and the particle group β calculated from the size distribution measurement, the peak intensity IA and IB, the minimum intensity IC, the intensity ratio IC/IA, the volume ratio Vα/Vβ, the f illing rate, the permeability, and the inductance decreasing rate of the soft magnetic powder measured from the core having the toroidal shape.

TABLE 1

| Sample No. | Soft magnetic metal of particle group α | Insulation coatng material of particle group α | Particle size of particle group α $P_A = P_{A1}$ (μm) | Particle size $P_{A2}$ (μm) | Soft magnetic metal of particle group β | Insulation coating material of particle group β | Particle size of particle group β $P_B = P_{B1}$ (μm) | Particle size $P_{B2}$ (μm) |
|---|---|---|---|---|---|---|---|---|
| Example 1 | Fe—B—Si—Cr | Phosphate glass | 10.1 | — | Fe | — | 0.5 | — |
| Example 2 | Fe—B—Si—Cr | Phosphate glass | 24.0 | — | Fe | — | 1.3 | — |
| Example 3 | Fe—B—Si—Cr | Phosphate glass | 24.0 | — | Fe | — | 1.3 | — |
| Example 4 | Fe—B—Si—Cr | Phosphate glass | 24.0 | — | Fe | — | 1.3 | — |
| Example 5 | Fe—B—Si—Cr | Phosphate glass | 52.3 | — | Fe | — | 1.3 | — |
| Example 6 | Fe—B—Si—Cr | Phosphate glass | 52.3 | — | Fe | — | 1.3 | — |
| Example 7 | Fe—B—Si—Cr | Phosphate glass | 52.3 | — | Fe | — | 1.3 | — |
| Example 8 | Fe—B—Si—Cr | Phosphate glass | 52.3 | — | Fe | — | 3.3 | — |
| Example 9 | Fe—B—Si—Cr | Phosphate glass | 52.3 | — | Fe | — | 1.3 | — |
| Example 10 | Fe—B—Si—Cr | Phosphate glass | 57.1 | — | Fe | — | 1.3 | — |
| Example 11 | Fe—B—Si—Cr | Phosphate glass | 62.2 | — | Fe | — | 1.3 | — |
| Example 12 | Fe—B—Si—Cr | Phosphate glass | 80.7 | — | Fe | — | 1.3 | — |
| Example 13 | Fe—B—Si—Cr | Phosphate glass | 18.5 | 52.3 | Fe | — | 1.3 | — |
| Example 14 | Fe—B—Si—Cr | Phosphate glass | 18.5 | 52.3 | Fe | — | 1.3 | 3.3 |
| Example 15 | Fe—B—Si—Cr | Phosphate glass | 52.3 | 18.5 | Fe | — | 1.3 | 0.5 |
| Example 16 | Fe—B—Si—Cr | — | 52.3 | — | Fe | — | 1.3 | — |
| Example 17 | Fe—B—Si—Cr | $SiO_2$ | 26.0 | — | Fe | — | 1.3 | — |
| Example 18 | Fe—Si—Cr | Phosphate glass | 48.0 | — | Fe | — | 1.3 | — |
| Example 19 | Fe—Ni—Si—Co | Phosphate glass | 26.0 | — | Fe | — | 1.3 | — |
| Example 20 | Fe—Si—B—Nb—Cu | Phosphate glass | 24.0 | — | Fe | — | 1.3 | — |
| Example 21 | Fe—B—Si—Cr | Phosphate glass | 52.3 | — | Fe | $SiO_2$ | 1.4 | — |
| Example 22 | Fe—B—Si—Cr | Phosphate glass | 52.3 | — | FeNi | $SiO_2$ | 0.8 | — |
| Example 23 | Fe | — | 44.0 | — | Fe | — | 1.3 | — |
| Comparative example 1 | Fe—B—Si—Cr | Phosphate glasss | 18.5 | 52.3 | Fe | — | 3.3 | 1.3 |
| Comparative example 2 | Fe | — | 1.3 | — | — | — | — | — |
| Comparative example 3 | Fe—B—Si—Cr | Phosphate glasss | 52.3 | — | — | — | — | — |
| Comparative example 4 | Fe—B—Si—Cr | Phosphate glasss | 52.3 | — | Fe | — | 1.3 | — |
| Comparative example 5 | Fe—B—Si—Cr | Phosphate glasss | 52.3 | — | Fe | — | 1.3 | — |

| Sample No. | Peak intensity $I_A = I_{A1}$ | Peak intensity $I_B = I_{B1}$ | Minimum intensity $I_C$ | Intensity ratio $I_C/I_A$ | Volume ratio Vα/Vβ | Filling rate of soft magnetic powder (vol %) | Permeability (3 MHz) | Inductance decreasing rate (when 10 A of DC bias current is applied) (%) |
|---|---|---|---|---|---|---|---|---|
| Example 1 | 3.96 | 1.94 | 0.03 | 0.008 | 3.96 | 80.3 | 35.1 | 13.4 |
| Example 2 | 3.83 | 2.20 | 0.23 | 0.060 | 3.28 | 81.8 | 39.2 | 16.8 |
| Example 3 | 4.12 | 1.71 | 0.30 | 0.073 | 4.55 | 78.5 | 32.1 | 15.1 |
| Example 4 | 3.58 | 2.68 | 0.33 | 0.092 | 2.53 | 77.5 | 32.5 | 14.5 |
| Example 5 | 3.72 | 2.39 | 0.04 | 0.011 | 3.04 | 82.6 | 41.4 | 31.4 |
| Example 6 | 3.99 | 1.91 | 0.05 | 0.013 | 3.96 | 81.0 | 40.5 | 32.8 |
| Example 7 | 4.18 | 1.46 | 0.03 | 0.007 | 5.07 | 76.5 | 31.2 | 33.5 |
| Example 8 | 4.07 | 1.74 | 0.39 | 0.096 | 4.46 | 76.8 | 31.9 | 32.6 |
| Example 9 | 3.42 | 2.95 | 0.03 | 0.009 | 2.09 | 76.7 | 31.8 | 32.0 |
| Example 10 | 3.91 | 2.04 | 0.01 | 0.003 | 3.73 | 76.0 | 35.0 | 38.8 |
| Example 11 | 3.93 | 2.03 | 0.01 | 0.003 | 3.75 | 75.8 | 35.3 | 40.9 |
| Example 12 | 3.96 | 2.01 | 0.01 | 0.003 | 3.79 | 76.2 | 36.1 | 43.7 |
| Example 13 | 3.88 | 1.97 | 0.11 | 0.028 | 3.37 | 81.5 | 40.4 | 25.8 |
| Example 14 | 3.48 | 1.38 | 0.41 | 0.118 | 3.25 | 76.9 | 30.4 | 19.1 |
| Example 15 | 3.69 | 1.36 | 0.08 | 0.021 | 3.36 | 81.8 | 40.1 | 25.2 |
| Example 16 | 4.11 | 1.72 | 0.05 | 0.012 | 4.50 | 75.6 | 30.6 | 34.2 |
| Example 17 | 3.66 | 1.70 | 0.26 | 0.071 | 4.12 | 78.8 | 31.6 | 15.4 |
| Example 18 | 4.08 | 1.77 | 0.06 | 0.015 | 4.19 | 78.2 | 32.0 | 30.8 |
| Example 19 | 4.11 | 1.88 | 0.27 | 0.066 | 4.08 | 79.1 | 36.9 | 36.6 |
| Example 20 | 3.84 | 2.09 | 0.19 | 0.049 | 3.88 | 82.0 | 40.9 | 21.2 |
| Example 21 | 3.78 | 2.22 | 0.08 | 0.021 | 3.38 | 82.3 | 41.6 | 32.2 |
| Example 22 | 3.73 | 2.37 | 0.05 | 0.013 | 3.13 | 81.9 | 42.8 | 36.1 |
| Example 23 | 3.96 | 1.75 | 0.41 | 0.104 | 4.13 | 76.1 | 31.2 | 31.6 |
| Comparative example 1 | 3.68 | 1.38 | 0.57 | 0.155 | 3.39 | 74.7 | 23.2 | 16.1 |
| Comparative example 2 | 9.60 | — | — | — | 0 | 61.0 | 9.6 | 0.5 |
| Comparative example 3 | 5.04 | — | — | — | 0 | 68.8 | 19.5 | 26.7 |
| Comparative example 4 | 4.24 | 1.40 | 0.04 | 0.009 | 5.62 | 74.8 | 28.4 | 34.3 |
| Comparative example 5 | 3.30 | 3.28 | 0.03 | 0.009 | 1.69 | 72.0 | 20.9 | 32.8 |

The examples 1 to 23 shown in Table 1 all satisfied the condition of the intensity ratio of IC/IA of 0.12 or less and the volume ratio Vα/Vβof 2.0 or more and 5.1 or less, also the examples 1 to 23 exhibited high permeability of more than 30.

According to Table 1, the comparative examples 1, 4, and 5 did not satisfy the condition of the intensity ratio of IC/IA of 0.12 or less and the volume ratio Vα/Vβof 2.0 or more and 5.1 or less. Further, the comparative examples 1, 4, and 5 had low filling rate of the soft magnetic metal powder, and the permeability was less than 30. Particularly, as shown in the comparative examples 2 and 3, when the sample only has the particle group α and has single size distribution, then the filling rate of the soft magnetic metal powder of the toroidal core cannot exceed 70 vol %, and the permeability at 3 MHz was 20 or less.

The examples 2, 5, 6, 13, 15, and 21 exhibited the intensity ratio IC/IA of 0.01 or more and 0.06 or less, the volume ratio Vα/Vβof 3.0 or more and 4.0 or less, the filling rate larger than 81 vol %, and the permeability of more than 39 which is high. The examples 2, 5, 6, 13, 15, and 21 exhibited good DC superimposition characteristic, and the inductance decreasing rate was 33% or less.

The examples 11 and 12 of which the peak particle size PA of the particle group α was larger than 60 μm exhibited relatively large specific permeability as shown in Table 1, but the inductance decreasing rate was larger than 40%, and also exhibited the deterioration of DC superimposition characteristic. However, when the peak particle size PA of the particle group α was 60 μm or less, then relatively good DC superimposition characteristic was obtained. The cause of the deterioration of DC superimposition characteristic is thought to be largely influenced by unevenness of the composition in the sample. This is because, when the peak particle size PA of the particle group α becomes larger, the space in the samples tends to enlarge as well, and thus it is speculated that the composition is at the state that the distribution of the resin part and the space part easily localize.

Note that, for the representative samples of the soft magnetic material shown in Table 1, the size distribution of the sample thereof are shown in FIG. 1 to 4.

FIG. 1 is a diagram showing the size distribution (frequency distribution) of the example 5. The particle group α shows relatively broad size distribution, but the peak particle size PA (52.3 μm) of the particle group α and the peak particle size PB (1.3 μm) of the particle group β are spaced apart, thus the minimum intensity IC present between the particle group α and the particle group β becomes small. Thus, the filling rate of the soft magnetic metal powder was 82.6 vol % which is high, and the permeability was 41.4 which is also high.

FIG. 2 is a diagram showing the size distribution of the example 15. The particle group α shows relatively broad size distribution, but the peak particle size PA (52.3 μm) of the particle group α and the peak particle size (1.3 μm) of the particle group β are spaced apart, thus the minimum intensity IC present between the particle group α and the particle group β becomes small. Thus, the filling rate of the soft magnetic metal powder was 81.8 vol % which is high, and the permeability was 40.1 which is also high.

Figure 3A:
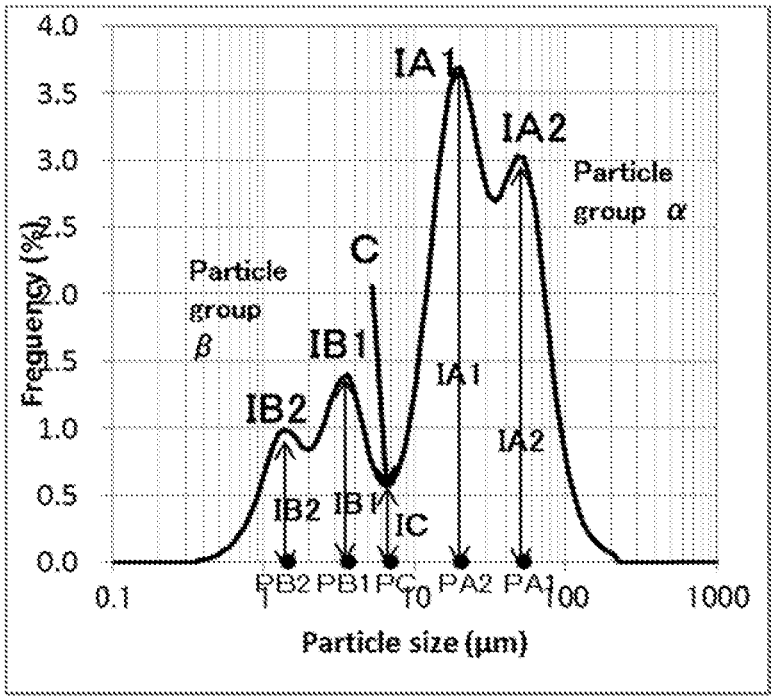
FIG. 3A is a diagram showing the size distribution (frequency distribution) of the soft magnetic material of the comparative example 1.
Figure 3B:
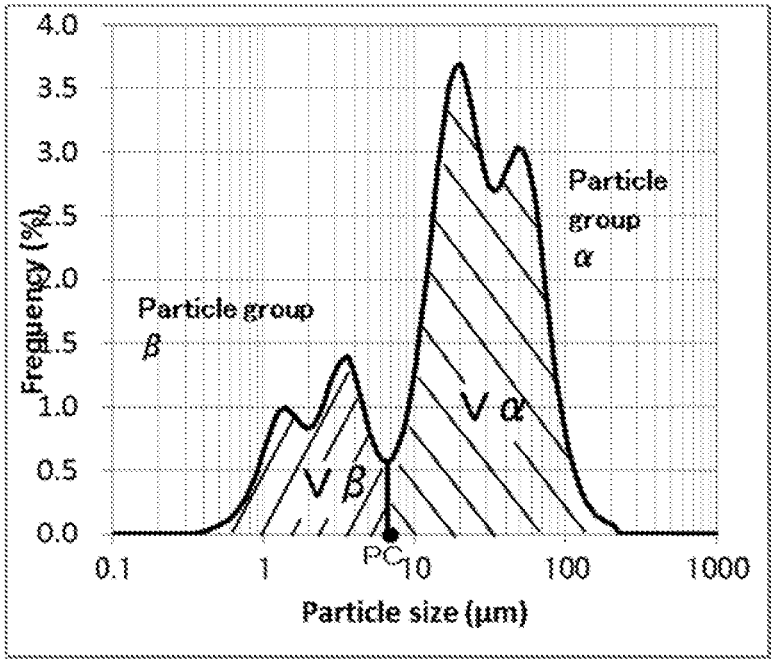
FIG. 3B is a diagram showing the size distribution (frequency distribution) of the soft magnetic material of the comparative example 1.

FIG. 3 is the diagram showing the size distribution (frequency distribution) of the comparative example 1. The particle group α has two peaks and shows a broad size distribution, and the peak particle size PA was 18.5 μm which is small. Therefore, the peak particle size PB of the particle group β was 3.3 μm which is relatively small, but the particle group α and the particle group β were close, thus the minimum intensity IC present between the particle group α and the particle group β was larger, and the IC/IA was larger than 0.12. The filling rate of this soft magnetic metal powder was 74.7 vol % which is lower than the examples, and the permeability was 23.2 which is low.

Figure 4:
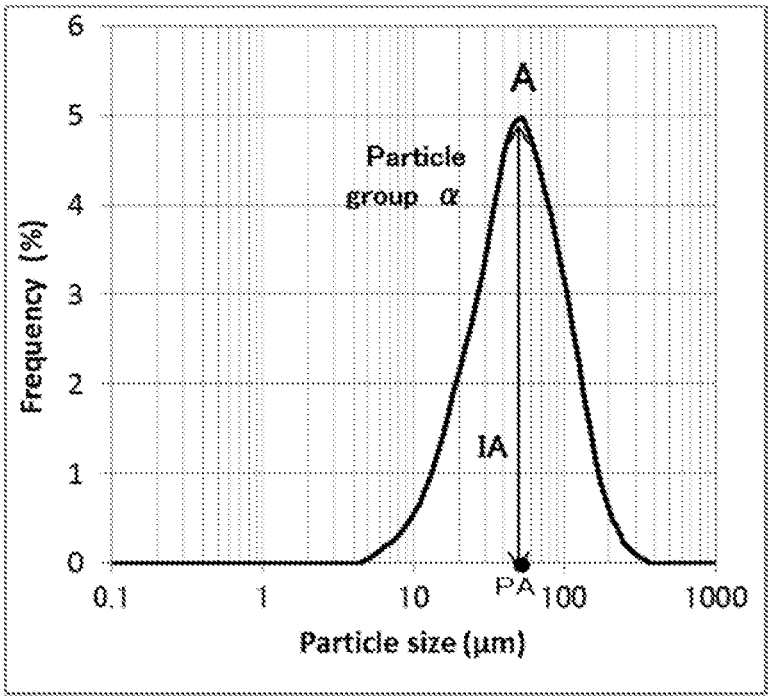
FIG. 4 is a diagram showing the size distribution (frequency distribution) of the comparative example 3.

FIG. 4 is the diagram showing the size distribution (frequency distribution) of the comparative example 3. The particle group α is only present and does not have the minimum intensity IC, and the filling rate of this soft magnetic metal powder was 68.8 vol % which is lower than the examples, and the permeability was 19.5 which is low.

The soft magnetic material of the present invention has high permeability and excellent DC superimposition characteristic, thus it can be widely used for inductor, electric and magnetic device such as various trances; and devices, equipment and systems or so which includes those.

REFERENCES OF NUMERICALS

1 Substrate
2 Internal conductor
3 Magnetic layer
4 External electrode
5 Element body
10 Thin film inductor

The invention claimed is:

1. A soft magnetic material comprising a soft magnetic metal powder and a resin, wherein said soft magnetic metal powder is comprised of a particle group α and a particle group β, the particle group α has a maximum peak intensity IA, the particle group β has a peak intensity IB, and a minimum intensity IC exist between the particle group α and the particle group β in a size distribution of said soft magnetic metal powder, a volume Vα of the particle group α and a volume Vβ of the particle group β satisfies a volume ratio Vα/Vβ of 2.0 or more and 5.1 or less, the maximum peak intensity IA of the particle group α is a peak intensity IA1 which is the largest peak intensity among peak intensities IA1, IA2 . . . IAx (x is 1 or larger) of the particle group α and a peak particle size PA of the particle group α is a peak particle size PA1 at the peak intensity IA1, the peak intensity IB of the particle group β is a peak intensity IB1 which is the largest peak intensity among peak intensities IB1, IB2 . . . IBy (y is 1 or larger) of the particle group β and a peak particle size PB of the particle group β is a peak particle size PB1 at the peak intensity IB1, and the peak particle size PA of the particle group α is larger than the peak particle size PB of the particle group β, and an intensity ratio IC/IA satisfies 0.12 or less.

2. The soft magnetic material as set forth in claim 1, wherein the peak particle size PA of said particle group α is 60 μm or less.

3. The soft magnetic material as set forth in claim 1, wherein the soft magnetic metal powder constituting said particle group α is Fe or a metal comprising Fe, and the soft magnetic metal powder of said particle group α is coated with an insulation material.

4. A core produced by the soft magnetic material as set forth in claim 1.

5. An inductor comprising the core as set forth in claim 4.

6. A soft magnetic material comprising a soft magnetic metal powder and a resin, wherein said soft magnetic metal powder is comprised of a particle group α and a particle group β, the particle group a has a maximum peak intensity IA, the particle group β has a peak intensity IB different from the peak intensity IA, and a minimum intensity IC exist between the particle group α and the particle group β in a size distribution of said soft magnetic metal powder, a volume Vα of the particle group α and a volume Vβ of the particle group β satisfies a volume ratio Vα/Vβ of 2.0 or more and 5.1 or less, and a peak particle size PA at the peak intensity IA of the particle group α is larger than a peak particle size PB of the peak intensity IB of the particle group β, and an intensity ratio IC/IA satisfies 0.12 or less.

7. The soft magnetic material as set forth in claim 6, wherein the peak particle size PA of said particle group α is 60 μm or less.

8. The soft magnetic material as set forth in claim 6, wherein the soft magnetic metal powder constituting said particle group α is Fe or a metal comprising Fe, and the soft magnetic metal powder of said particle group α is coated with an insulation material.

9. A core produced by the soft magnetic material as set forth in claim 6.

10. An inductor comprising the core as set forth in claim 9.

* * * * *